US005482408A

United States Patent [19]

Lunardi

[11] Patent Number: 5,482,408

[45] Date of Patent: Jan. 9, 1996

[54] EMBANKMENT FORMED BY PREFORMED COLLABORATING ASSEMBLABLE ELEMENTS, IN PARTICULAR FOR ROAD OR RAILWAY CONSTRUCTIONS, AND PROCESS

[75] Inventor: Pietro Lunardi, Milan, Italy

[73] Assignee: Impresa Concari Prefabbricati di P. Concari, Parma, Italy

[21] Appl. No.: 136,945

[22] Filed: Oct. 18, 1993

[30] Foreign Application Priority Data

Oct. 30, 1992 [IT] Italy ..... MI92A2503

[51] Int. Cl.[6] ..... E02D 29/02

[52] U.S. Cl. ..... 405/286; 405/284

[58] Field of Search ..... 405/258, 262, 405/272, 273, 284, 285, 286, 287

[56] References Cited

U.S. PATENT DOCUMENTS 3,343,301 9/1967 Adelman .

5,131,791 7/1992 Kitziller .

FOREIGN PATENT DOCUMENTS 0006828 6/1979 European Pat. Off. .
0357950 8/1989 European Pat. Off. .
2737322 2/1978 Germany .
8532773 3/1986 Germany .
59882 11/1969 Luxembourg .
276951 8/1951 Switzerland .
2184472 6/1987 United Kingdom .

*Primary Examiner*—David H. Corbin
*Attorney, Agent, or Firm*—Birch, Stewart, Kolasch & Birch

[57] ABSTRACT

Prefabricated concrete assemblable elements are fastened together so as to form a light cellular leading structure with high resistance. The elements can be three-dimensional, box-shaped or angle-shaped, or they can be of a two-dimensional board type, provided with connection joints at their edges. A lower slab and an upper slab, preformed or laid in situ, complete the embankment and allow the elements to cooperate.

23 Claims, 6 Drawing Sheets

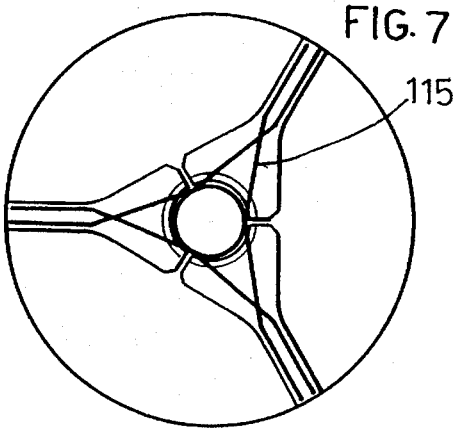
FIG. 7
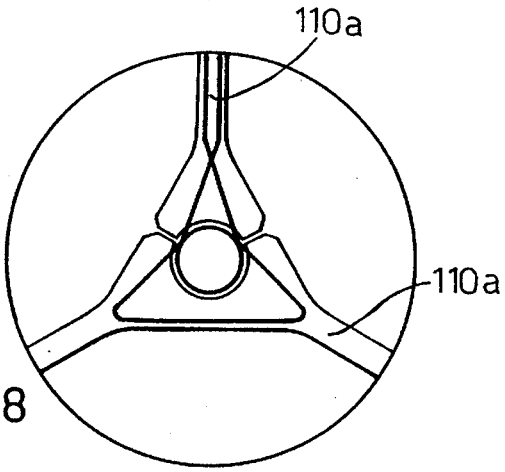
FIG. 8
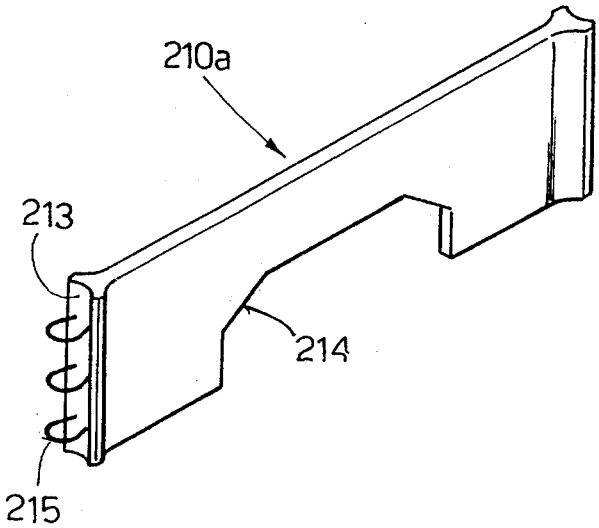
FIG. 10
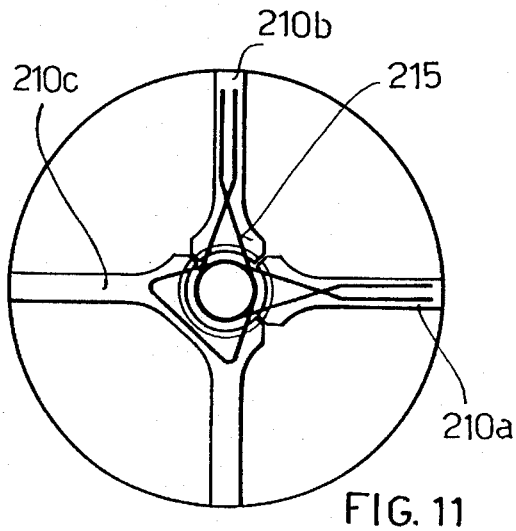
FIG. 11
FIG. 12
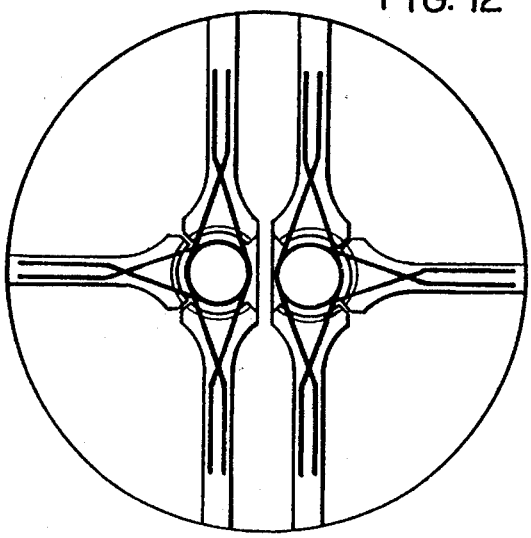

EMBANKMENT FORMED BY PREFORMED COLLABORATING ASSEMBLABLE ELEMENTS, IN PARTICULAR FOR ROAD OR RAILWAY CONSTRUCTIONS, AND PROCESS

BACKGROUND OF THE INVENTION

1. Field of the Invention

The present invention refers to the field of construction of road substructures, referring in particular to the construction of embankments for road and/or railway structures.

Embankments are defined as those works whose funtion is to support the roadway at higher levels with respect to the levels of the surrounding land. Such function is required when levels must be reached which are necessary for crossing any obstacle to the route (water courses, roads, railways etc.) by means of a bridge, or when the natural morphology of the land does not allow the construction of roads, in narrow zones, with the necessary altimetric characteristics (limited variations in gradient), 2. Description of the Background Art The state of the art comprises the use of natural soil with special characteristics for the realization of embankments, The materials employed in the realization of the embankments are, in the first place, dry earth, gravel and sand. It is also possible to use mixed-type earth (sand silt or sandy clay), paying particular attention to laying the mixed-type earth in its original place. Unfortunately the best materials for building embankments are difficult to find in the trade because of the limited availability of quarries for their extraction, being subject to increasingly tight restrictions. Therefore the choice often falls on the use of materials which are easier to find but scarcely suitable for the required use, and which, therefore, require additional processing and particular attention for being correctly laid in-situ.

The characteristic cross sectional shape of embankments is a trapezium, with its smaller base consisting of the roadway and the sides sloping obliquely. It is easy to deduce that the planimetric overall dimensions of an embankment of average height (5–6 metres) are considerable; for example, for a height of 5 metres and an inclination of ⅔, 15 metres of ground beyond the width of the roadway are needed just for the slopes.

A further drawback with traditional embankments consists in the weight of the embankment itself, which involves the risk of the embankment warping or sagging with respect to the plane of site, or of differential sagging along the development of the embankment itself; it should be noted that the embankment/foundation contact pressures are about 90,0/95,0 kPa, equal to those which a 10-storey building might exert on a continuous two-dimensional foundation.

Recently, in an attempt to avoid, in part at least, the above-mentioned drawbacks, extra-light standard size and shape cellular blocks made of thermoformed plastic material have been put on the market; such blocks have a shape with several honeycomb cells, and they are positioned side by side with each other on work and they are overlapped at random; then they are covered with a non-woven fabric and covered over with earth.

These elements, however, do not collaborate structurally with each other, and besides they do not avoid the necessity of realizing the embankments with lateral slopes, and hence with the overall dimensions and drawbacks involved.

SUMMARY OF THE INVENTION

The object of the present invention is to provide for the construction of lighter embankments, with reduced load on the ground and reduced possibility of warping. A further object is to carry out embankments reducing the necessity of making use of extraction materials. Yet another object is to make it possible to realize the embankments in a rapid manner. A further object is to permit the realization of naturally sound embankments, so that the lateral slopes can be eliminated or reduced, and so as to permit the realization of through passages during the construction phase, without the need to resort to subsequent demolition and traditional operations.

The above and other objects have been achieved with an embankment composed of prefabricated reinforced concrete elements, fastened together, usually by means of reinforced concrete castings, and assembled in such a way as to have empty spaces between cement walls. The prefabricated elements foreseen comprise substantially flat or "two-dimensional" panel elements, "three-dimensional elements" comprising one or more spaced upright parts connected by walls; angles elements comprising two or more angled walls between them. The walls can comprise openings to allow the work to be inspected.

The new structure can completely replace the traditional embankment.

The present invention avoids the drawbacks arising from the shortage of materials for embankments on the market, eliminates both the necessity of putting a layer of coarse aggregate in contact with the ground to prevent the water in the embankment reascending by capillarity, and the necessity of compactor machinery on site, with the long time this involves for spreading and compacting.

The present invention reduces assembling and disassembling times and related costs by also eliminating the influence of atmospheric conditions on the successful formation of the embankment.

The present invention allows the overall dimensions of the body of the embankment to be reduced, which is particularly important in the case of constructions inserted in urban contexts, where available space is particularly restricted.

The present invention reduces the weight of the embankment, thus eliminating the need for consolidating the substructure on poor load-bearing ground. By suitably deepening the foundation bed, it is possible to avoid to transmit overloads to the ground and thus totally eliminate later sagging, so avoiding all the drawbacks which would be involved in the later formation of depressions and discontinuity in the roadway.

The present invention addition, it eliminates the need for maintenance, as it is not subject to erosion by flowing water; it is easy to inspect, it permits small openings to be spanned; the realization of underpasses and through holes in general (for services to pass, such as telephone lines, electric lines etc.) during the realization phase, for example, without the necessity of long, expensive additional operations after the work has been completed.

The process does away with the construction of scaffolding and relative forms casting in situ, and all the operations for removing the forms after the concrete has cured.

BRIEF DESCRIPTION OF THE DRAWINGS

Some preferred embodiments of the embankment will be described below, with reference to the appended drawings, in which they are illustrated merely for the sake of example and not restrictively;

FIGS. 7 and 8 are plan views of joints realized between the elements in FIG. 6;

FIG. 10 is a perspective view of an element;

FIG. 11 is a plan view of a joint of the structure in FIG. 9;

FIG. 12 is a plan view of an expansion joint of the structure in FIG. 9;

DETAILED DESCRIPTION OF THE PREFERRED EMBODIMENTS

Figure 1:
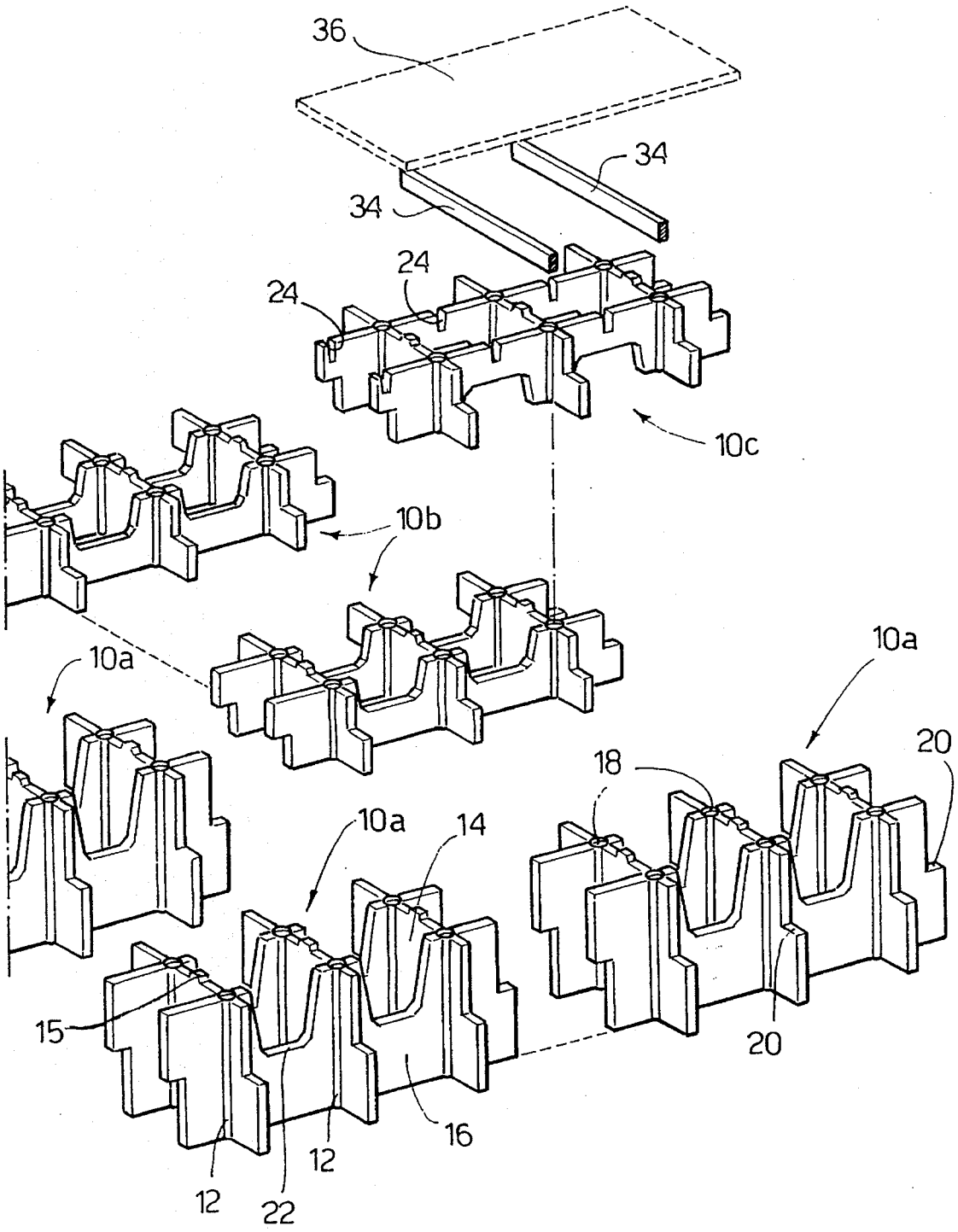
FIG. 1 is an exploded perspective view of a first type of assemblable elements.

In the FIGS. from 1 to 3 a first embodiment of assemblable elements for an embankment is illustrated.

The embandment structure includes component elements 10 which, in this case, comprise base elements 10*a*, intermediate elements 10*b* and upper elements 10*c* of different height. Each component or article 10 comprises a certain number of upright parts 12 (six in the illustrated embodiment) connected by bracing walls or plates 14, 16 at right angles to each other. The upright parts are practically made up of the crossing areas of the walls 14, 16 and preferably are provided with a through hole 18 with a vertical axis, and/or male and female centring and connector parts. Both the walls 14 and the walls 16 are provided with a stepped end 20 for connection between adjacent elements. The longitudinal walls 16 are preferably provided with lightening slots or cutouts 22, to allow a passage for inspection, if needed. Element 10*c* also has seats 24 in the longitudinal walls.

Figure 2:
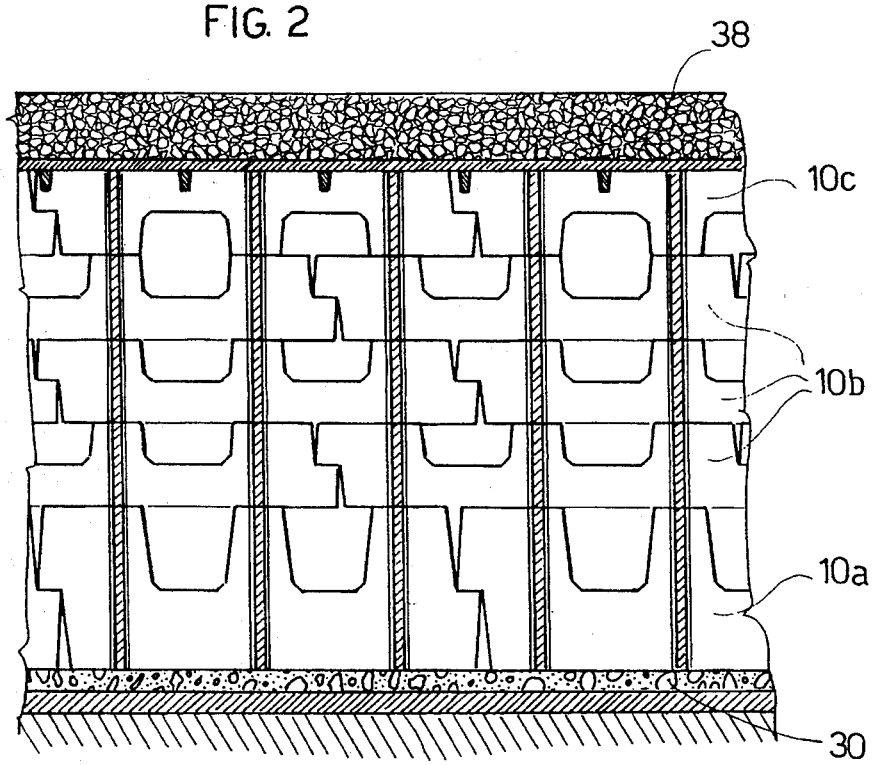
FIG. 2 is a longitudinal sectional view along an embankment composed with the elements in FIG. 1.
Figure 3:
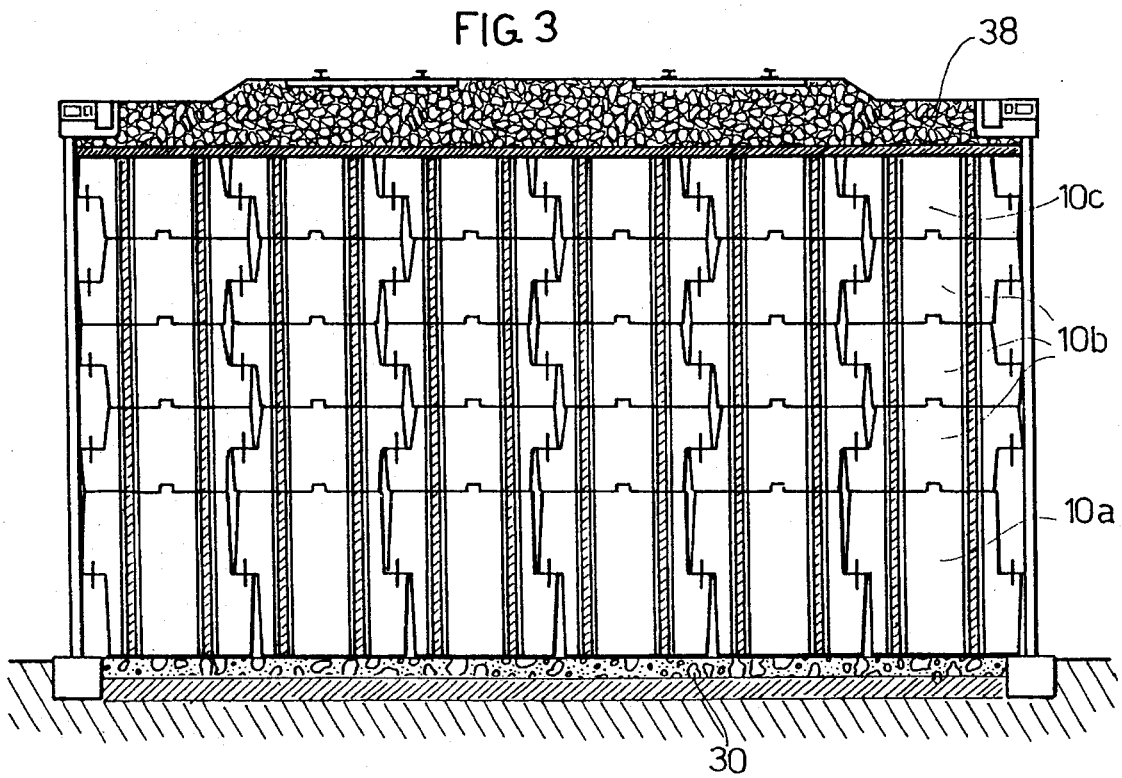
FIG. 3 is a cross-sectional view of the embankment in FIG. 2.
Figure 4:
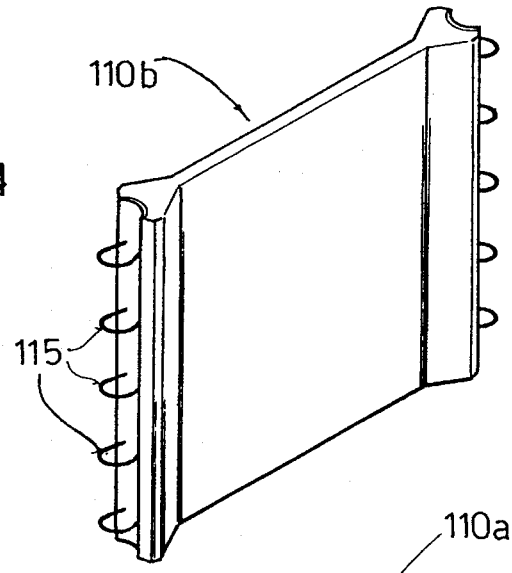
FIG. 4 is a perspective view of a panel of a second embodiment of the embankment of the present invention.

The embankment comprises a foundation 30 (FIG. 2 and 3), realized in any way whatsoever accessible to one skilled in the art, which comprises, for example, a layer of stabilized material, a layer of non-woven fabric to act against contamination, and a layer of grouted aggregate. On this foundation the base elements 10*a* are laid, with their longitudinal walls 16 positioned in the longitudinal direction of the structure and the stepped walls 22 of side-by-side and adjacent elements connected longitudinally by means of fixed joints (not illustrated) of the transverse walls. Above the base elements, one or more layers of elements 10*b* are laid, which are centered on the upper edges of the elements positioned below, by means of the centring elements 15 and of the male and female parts, if any, in correspondence with the vertical crosses or uprights between the walls, and they are connected with each other analogously to the base elements by means of mutual engagement of stepped parts and fixed joints, if any. The upper layer consists of the top elements 10*c*. The vertical connection between the various layers of elements is effected by mutual engagement of the male and female elements (not illustrated) or by means of vertical reinforcement bars inserted in holes 18 and grouted there.

Finally, at the top the embankment is completed by transverse joists 34 received in the seats 24, and by a top slab 36 preformed or realized in situ, in order to improve the cooperation among the elements. On the top slab the roadbed or, as in the case in the figure, the railway bed 38 can be laid.

Figure 5:
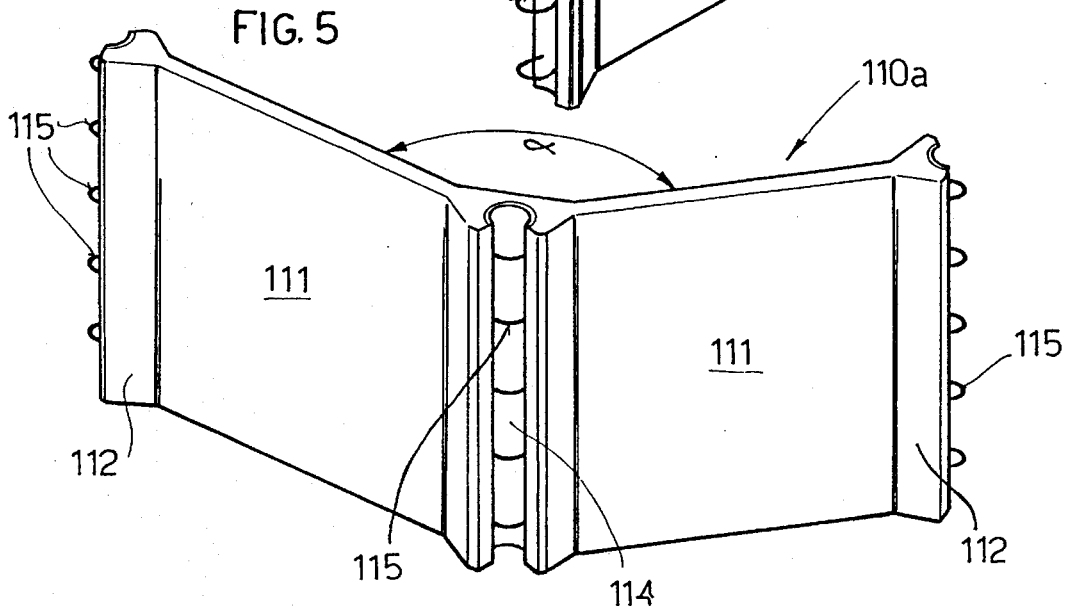
FIG. 5 is a perspective view of a further element of the second embodiment of the embankment.
Figure 6:
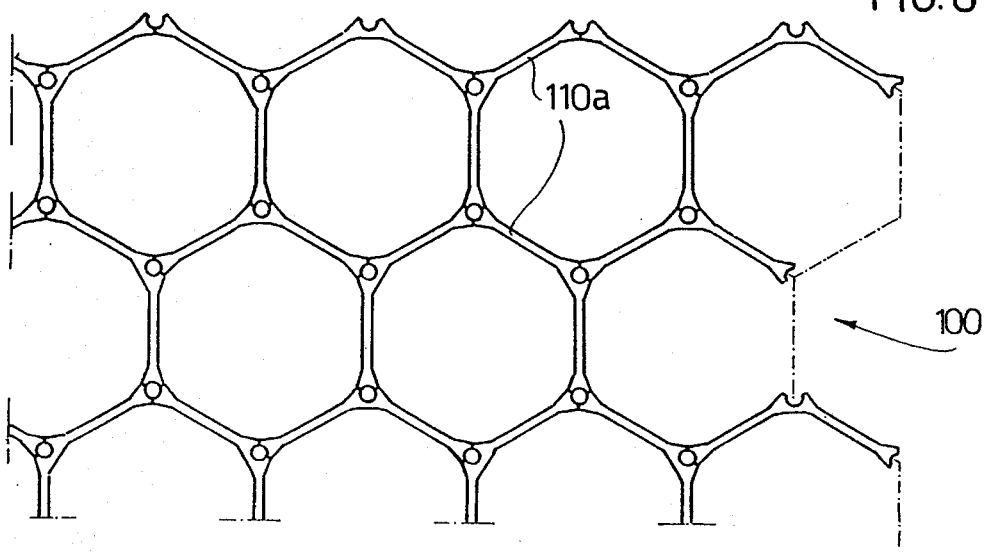
FIG. 6 is a plan view of a structure assembled with the panels in FIGS. 4 and 5.
Figure 9:
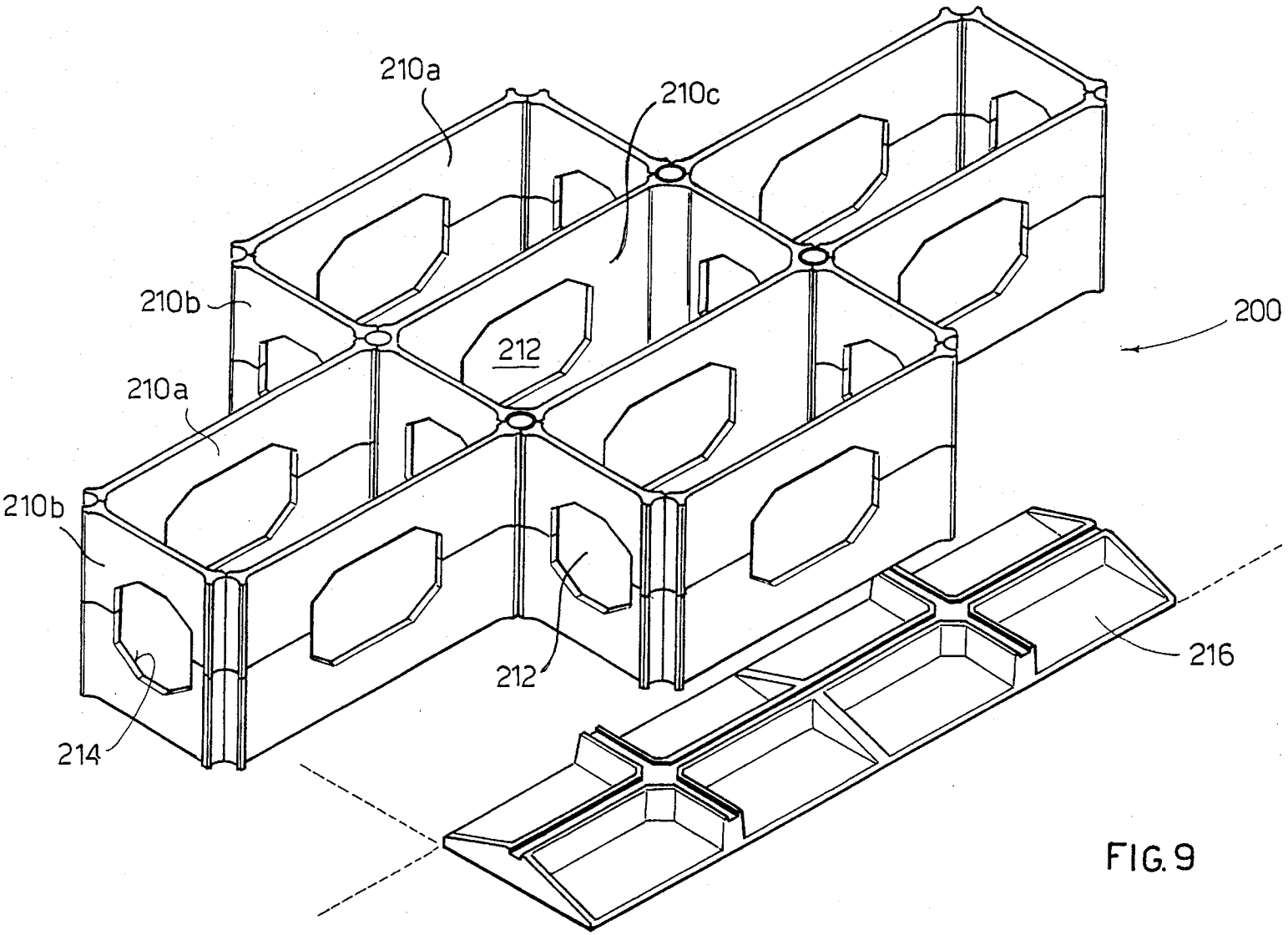
FIG. 9 is an exploded perspective view of a further embodiment of the assembled panels.

The FIGS. from 4 to 8 refer to another embodiment of the embankment, which in this case is indicated as a whole with 100. It comprises component elements 110*a* (FIG. 5), made of concrete which is possibly reinforced, each consisting of a pair of integral plates or walls 111, at an angle to each other, provided with connection means at their extreme edges 112, 112 and in correspondence with the outer face of the edge 114 along which they are rigidly joined. The connection means generally comprises a longitudinal groove (preferably in the shape of a cylinder portion) and a series of projecting metallic anchorages or clamps indicated with 115. The plates 111 can be solid or perforated, as desired. The angle $\alpha$ defined between them preferably is of about 120°. The system also comprises wall elements 110*b* with a single wall, provided with wall clamps or brackets 115 at their vertical edges. The elements 110*a* can be assembled easily in situ, on a foundation (not illustrated) with the walls 111 positioned along vertical planes, so as to form a three-dimensional structure with hexagonal cells, as seen in plan view. The adjacent vertical edges define cylindrical holes between them, and are connected by a concrete casting carried out in the cylindrical hole and incorporating the projecting wall clamps 115.

The elements 110*b* combined with the elements 110*a* are generally used near the margins of the structure or near any discontinuity in the structure. The structure 100 can be completed at the top and at the sides in any suitable way whatsoever, for example as is described in the case of the structure 1.

It will be appreciated that the elements 100*a, b* have minimum overall dimensions when being transported, since they can be piled up practically without leaving empty spaces between them, and moreover they can be assembled in a three dimensional form which is highly resistant to stress. A further advantage consists in the fact that the elements 10*a* rest on the ground with their walls positioned vertically, and are stable without any need for propping.

A further embodiment of the embankment is shown with 200 and illustrated in FIGS. 9–12.

The structure 200 essentially includes plate elements 210*a*, 210*b*, comprising a substantially flat wall with connection edges preferably formed with holes or grooves 213 in the shape of a cylinder portion, and projecting wall clamps or brackets 215; the elements 210*a* and 210*b* in the example illustrated differ from each other only in dimensions. The structure 200 preferably comprises also three-dimensional elements 210*c*, preferably rectangular or square in plan view, provided with connection means along their edges. Preferably the plate elements 210*a* and 210*b* have lengthways dimensions as the sides of the three-dimensional element, and this preferably has a height double that of the plate element.

The walls of the three dimensional element can be provided with inspection openings 212 and the plate elements can have cutouts 214 which combine with adjacent elements to form inspection openings.

The embankment is assembled preferably by combining three-dimensional elements and flat elements according to building needs, on a prefabricated base 216; however it is possible to assemble structures which are composed totally of elements 210*a* or composed totally of elements 210*b*, or 210*c*. The consolidation between the elements is effected, as in the previous cases, by means of a concrete casting, in each vertical hole, possibly previously reinforced, which is defined between the edges of the elements; the casting will incorporate the clamps 215. The structure can be completed by a top slab cast in situ.

Figure 13:
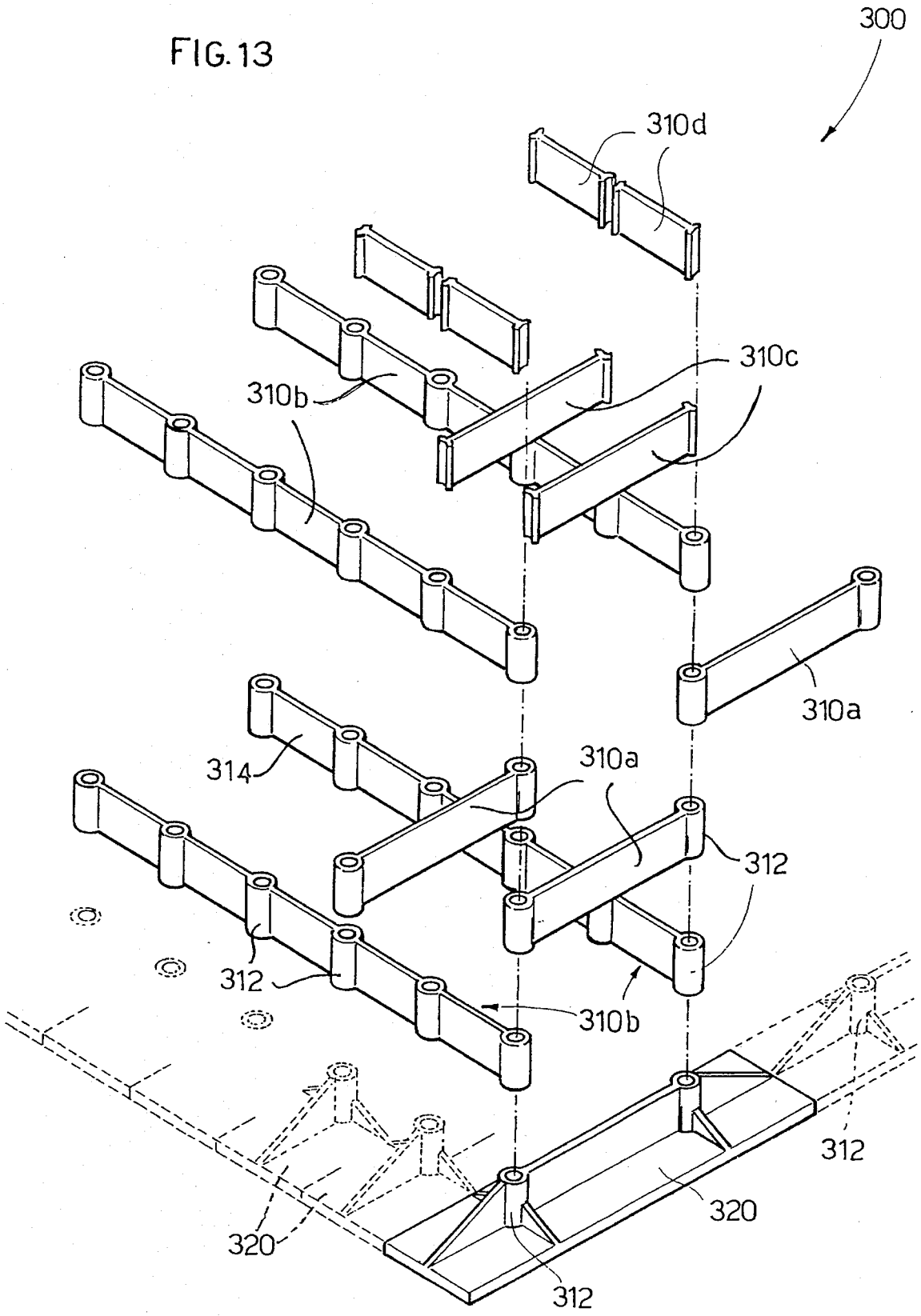
FIG. 13 is an exploded perspective view of a further embodiment of the embankment.

In FIG. 13 a further embodiment of embankments is illustrated and indicated as a whole with 300. Such embodiment 300 essentially comprises assemblable elements made of concrete, indicated with 310*a*, 310*b*, in the form of panels; the elements 310 have upright tubular end parts, 312, joined by a usually flat wall 314. The elements 310*b* have several parallel tubular upright portions 312, spaced out from each other and joined by substantially flat walls 314. The length, height and thickness of the walls 314 can obviously vary according to design criteria, however the intention is that it is an advantage to use one or two standard lengths.

The embankment 300 is assembled by combining, on a foundation, base elements 320 provided with spaced out vertical tubular uprights 312, a series of elements 310*b* positioned parallel to each other transversely to the longitudinal direction of the embankment and, on such first series, a first series of spaced out elements 310*a*, positioned transversely to the elements 310*b* and each connecting two elements 310*b*. On the said first series of elements 310*a*, a second series of elements 310*a* is laid, connecting the elements 310*b* not connected by the first series, and so on. A top capping series can be made up of elements 310, *c, d*, substantially similar to those indicated with 210*a, b* in the previous figures. The structure is completed by inserting reinforcements in the vertical openings defined by the overlapped parts 312, and by casting concrete into each of the openings. Then a top slab is cast in situ.

The sides of each of the said structures can be covered with earth and grass, vegetation bed with plants etc.

The said assemblable elements can be prefabricated with known prefabrication techniques in a factory. Preferred materials are reinforced concrete (preferably concrete of the Rck=350 kg/cm$^2$ class or higher) or cement mix reinforced with metallic fibres.

Obviously the invention is capable of variations and modifications within the scope of the normal ability of one skilled in the art.

I claim:

1. An embankment for road or railway constructions, comprising:

a plurality of pre-formed elements including consolidation means for consolidating said pre-formed elements to each other;

a foundation on top of which said plurality of pre-formed elements are consolidated; and a top slab for placement on top of said plurality of preformed elements which are consolidated on top of said foundation;

wherein said plurality of pre-formed elements define empty spaces therebetween after said embankment is assembled.

2. An embankment according to claim 1, wherein said pre-formed elements are formed from concrete, and have upright parts which define vertical holes; and wherein said consolidation means comprise a concrete casting in said vertical holes, the upright parts being made monolithic by means of reinforcements and said concrete casting, wherein said top slab and said foundation form an upper and a lower plane of said embankment.

3. An embankment according to claim 1, wherein said performed elements comprise inspection openings for allowing entry of a person through said inspection openings after said embankment is assembled.

4. An embankment according to claim 1, wherein said consolidation means include fixed joints with male and female parts.

5. An embankment according to claim 3, wherein said plurality of pre-formed elements comprise upright parts with a vertical hole said upright parts being joined by a plurality of bracing walls.

6. An embankment according to claim 5, wherein said bracing walls of the elements have stepped ends.

7. An embankment according to claim 5, wherein at least some of said bracing walls have inspection openings for allowing entry of a person through said inspection openings after said embankment is assembled.

8. An embankment according to claim 5, wherein at least some of said bracing walls have male and female formations for reciprocal engagement.

9. An embankment according to claim 1, wherein said plurality of pre-formed elements include elements having two walls integrally formed at an angle to each other, with end portions of said two walls provided with connecting means for connecting said pre-formed elements to one another.

10. An embankment according to claim 9, wherein said connecting means have longitudinal grooves with projecting brackets, and the edge of the angle at which said two walls are formed also has a longitudinal groove with brackets.

11. An embankment according to claim 9, wherein the angle between the walls is about 120° and the plurality of pre-formed elements of the embankment are assembled forming cells having a hexagonal shape.

12. An embankment according to claim 9, wherein said plurality of pre-formed elements include substantially flat assemblable elements, with connection edges provided with longitudinal holes or grooves with clamps.

13. An embankment according to claim 1, wherein said plurality of pre-formed elements include:

plate elements with connection edges;

box-like elements with connection edges positioned along their edges assembled by means of a concrete casting in vertical holes defined by said connecting edges and made integral with the top slab and the foundation forming an upper and a lower plane.

14. An embankment according to claim 13, wherein at least some of said elements have inspection openings for allowing passage of a person through said inspection openings after said embankment is assembled.

15. An embankment according to claim 13, wherein a height of said box-like elements is double that of the plate elements.

16. An embankment according to claim 13, wherein said foundation includes prefabricated base elements with seats for said plurality of pre-formed elements.

17. An embankment according to claim 1, wherein said plurality of pre-formed elements include assemblable elements having upright tabular parts, connected with each other by plate walls, said assemblable elements being made integral by concrete castings inside holes obtained by overlapping said tubular uprights and allowing the embankment to be made monolithic with the top slab and the foundation forming an upper and a lower plane.

18. An embankment according to claim 17, wherein at least some of said assemblable elements include at least three upright tubular parts connected by substantially coplanar walls.

19. A structure according to claim 13, wherein said foundation includes prefabricated base elements with seats for said plurality of preformed elements.

20. An embankment according to claim 1, wherein a roadbed is provided on said top slab.

21. An embankment according to claim 1, wherein a railway bed is provided on said top slab.

22. A prefabricated concrete elements assembly provided with elements for consolidating to each other, comprising at least the following assemblable elements:

concrete plate elements with connection edges;

concrete box-like elements with connection edges positioned at each corner thereof, wherein said box-like elements have a height which is double a height of the plate elements, said box-like elements and said plate elements being consolidated to each other in order to form said prefabricated concrete elements assembly which define a plurality of empty spaces.

23. A construction process of an embankment by means of prefabricated elements, comprising the steps of:

providing a base slab;

assembling concrete prefabricated elements, which connect to said base slab and form, among them, vertical connection holes;

casting concrete in said vertical connection holes;

placing an upper connection slab on top of said assembled concrete prefabricated elements;

wherein said concrete prefabricated elements define empty spaces therebetween after the embankment is assembled.

* * * * *